US009061530B2

(12) United States Patent
Tsuchiya et al.

(10) Patent No.: US 9,061,530 B2
(45) Date of Patent: Jun. 23, 2015

(54) PRINTER APPARATUS

(71) Applicant: FUJITSU COMPONENT LIMITED, Tokyo (JP)

(72) Inventors: Masahiro Tsuchiya, Tokyo (JP); Yukihiro Mori, Tokyo (JP); Sumio Watanabe, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/471,238

(22) Filed: Aug. 28, 2014

(65) Prior Publication Data

US 2014/0368598 A1 Dec. 18, 2014

Related U.S. Application Data

(63) Continuation of application No. PCT/JP2013/054827, filed on Feb. 25, 2013.

(30) Foreign Application Priority Data

Mar. 2, 2012 (JP) ..... 2012-046990

(51) Int. Cl.

| | |
|---|---|
| ***B41J 2/325*** | (2006.01) |
| ***B41J 13/076*** | (2006.01) |
| ***B41J 2/32*** | (2006.01) |
| ***B41J 11/04*** | (2006.01) |
| ***B41J 25/312*** | (2006.01) |
| ***B41J 25/316*** | (2006.01) |
| ***B41J 15/04*** | (2006.01) |

(52) U.S. Cl.

CPC *B41J 13/076* (2013.01); *B41J 2/32* (2013.01); *B41J 11/04* (2013.01); *B41J 25/312* (2013.01); *B41J 25/316* (2013.01); *B41J 15/042* (2013.01)

(58) Field of Classification Search

USPC ..... 347/171, 179, 197, 198, 222

See application file for complete search history.

(56) References Cited

U.S. PATENT DOCUMENTS

| | | | |
|---|---|---|---|
| 6,249,302 | B1 | 6/2001 | Sekiya |
| 6,336,760 | B2 | 1/2002 | Mori et al. |
| 7,561,173 | B2 | 7/2009 | Hirai |
| 2006/0291933 | A1 | 12/2006 | Watanabe et al. |
| 2009/0153640 | A1 | 6/2009 | Hirai et al. |
| 2011/0074903 | A1 | 3/2011 | Takahashi |

FOREIGN PATENT DOCUMENTS

| | | |
|---|---|---|
| EP | 1323535 | 4/2005 |
| JP | 2000-094767 | 4/2000 |

(Continued)

OTHER PUBLICATIONS

International Search Report mailed on May 14, 2013.

*Primary Examiner* — Kristal Feggins

(74) *Attorney, Agent, or Firm* — IPUSA, PLLC

(57) ABSTRACT

A printer apparatus includes a frame, a printer head, a platen roller that is supported by the frame, a biasing member that is provided between the frame and the printer head and configured to exert force toward the platen roller, and an opening/closing arm supported by the frame to rotate and move about an arm rotation shaft. A contact part between the opening/closing arm and a platen bearing of the platen roller is positioned opposite from a side in which the printer head is provided with respect to a line that connects a center of the arm rotation shaft and a center of the platen bearing.

7 Claims, 15 Drawing Sheets

(56) References Cited

FOREIGN PATENT DOCUMENTS

| | | |
|---|---|---|
| JP | 3599595 | 12/2004 |
| JP | 3734753 | 1/2006 |
| JP | 2008-068551 | 3/2008 |
| JP | 2009-143133 | 7/2009 |
| JP | 2011-056956 | 3/2011 |
| JP | 2011-073372 | 4/2011 |

PRINTER APPARATUS

CROSS-REFERENCE TO RELATED APPLICATIONS

This application is a U.S. continuation application filed under 35 USC 111(a) claiming benefit under 35 USC 120 and 365(c) of PCT application PCT/JP2013/054827, filed Feb. 25, 2013, which claims priority to Application Ser. No. 2012-046990, filed in Japan on Mar. 2, 2012. The foregoing application is hereby incorporated herein by reference.

FIELD

The embodiments discussed herein are related to a printer apparatus.

BACKGROUND

A printer apparatus for outputting a receipt or the like is widely used for various purposes such as a cashier terminal of a shop or an ATM (Automated Teller Machine) or a cash dispenser of a bank. For example, a printer apparatus outputs a receipt by printing characters or the like on a recording paper (e.g., heat sensitive paper) with a thermal head while conveying the recording paper.

When using the printer apparatus, characters or the like are printed on the recording paper by providing the recording paper between the thermal head and a platen roller. The platen roller is detachably attached to the printer apparatus, so that the recording paper can be easily provided between the thermal head and the platen roller.

Accordingly, the recording paper is sandwiched between the thermal head and the platen roller by pressing the thermal head toward a side in which the platen roller is provided. In this state where the recording paper is sandwiched between the thermal head and the platen roller, printing by the thermal head is performed.

Thus, typically, a biasing member (e.g., coil spring) is provided behind the thermal head. One end of the coil spring or the like contacts the thermal head whereas the other end of the coil spring or the like contacts a rear surface support plate. Thereby, a recovering force of the coil spring or the like causes pressure to be exerted to the thermal head in the direction toward the platen roller via the rear surface support plate.

Patent Document 2 discloses a lock arm that supports a bearing of a platen roller in which a position of the platen roller is defined by using a biasing force of a pressure spring exerting pressure to a thermal head. Patent Document 4 discloses a configuration that includes a first spring provided between a lock arm and a thermal head for biasing a platen roller in a direction toward the thermal head, and a second spring provided between the thermal head and a frame body for biasing the thermal head in a direction to contact the platen roller.

[Patent Document 1]: Japanese Patent No. 3734753

[Patent Document 2]: Japanese Patent No. 3599595

[Patent Document 3]: Japanese Laid-Open Patent Publication No. 2000-318260

[Patent Document 4]: Japanese Laid-Open Patent No. 2008-68551

[Patent Document 5]: Japanese Laid-Open Patent No. 2000-94767

Typically, in a case of a thermal printer that prints characters or the like on a recording medium by using a thermal head, a platen roller is retained by a lock arm by way of, for example, a platen bearing formed of a mold resin or the like. The thermal printer that is used for various purposes may be accidentally dropped or applied with an unexpected amount of force when the thermal printer is being used. In this case, the platen bearing or other members of the platen roller may be damaged (malfunction) and become unusable if the platen roller cannot disengage from the thermal printer.

Specifically, in a case of, for example, a thermal printer that has a lock arm formed in its disengaging direction (removing direction) in a manner covering a large portion of the platen bearing or the like of the platen roller, the platen roller may not easily disengage from the thermal printer even if force is exerted to the thermal printer when the thermal printer is dropped. Thus, if the platen roller cannot disengage from the thermal printer, the platen bearing or the like could be damaged by the impact caused when, for example, the thermal printer is dropped. As a result, the thermal printer can no longer be used.

SUMMARY

According to an aspect of the invention, there is provided a printer apparatus that includes a printer head that prints on a recording paper, a platen roller that is supported by a frame, a biasing spring that is provided between the frame and the printer head and configured to exert force toward the platen roller, and an opening/closing arm supported by the frame to rotate and move about an arm rotation shaft. A contact part between the opening/closing arm and a platen bearing of the platen roller is positioned opposite from a side in which the printer head is provided with respect to a line that connects a center of the arm rotation shaft and a center of the platen bearing

DESCRIPTION OF EMBODIMENTS

Figure 1:
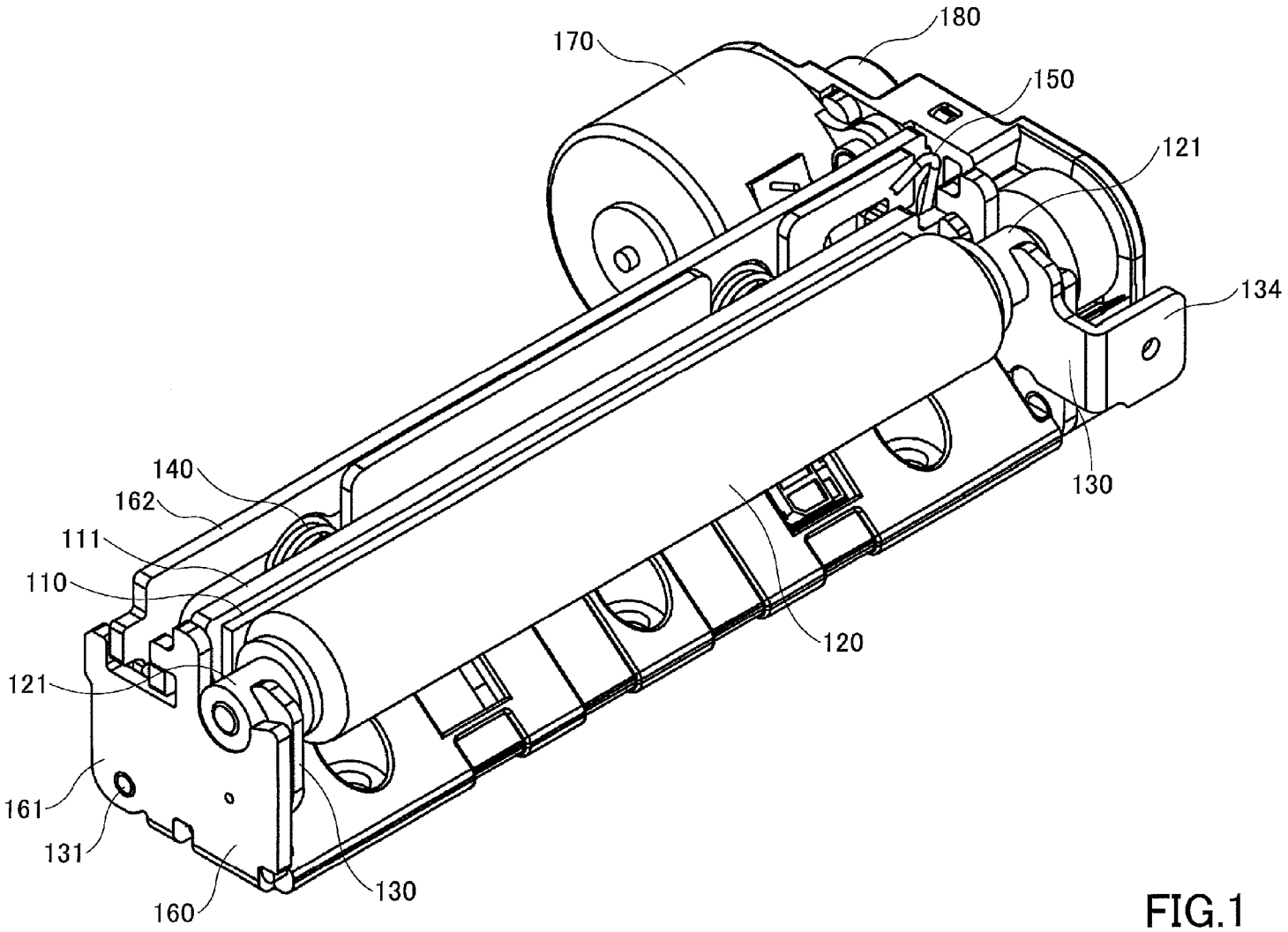
FIG. 1 is a perspective view of a printer apparatus according to an embodiment of the present invention.

In the following, embodiments of the present invention are described with reference to the accompanying drawings. Like components are denoted with like reference numerals and are not further explained.

<Structure of Printer Apparatus>

Figure 2:
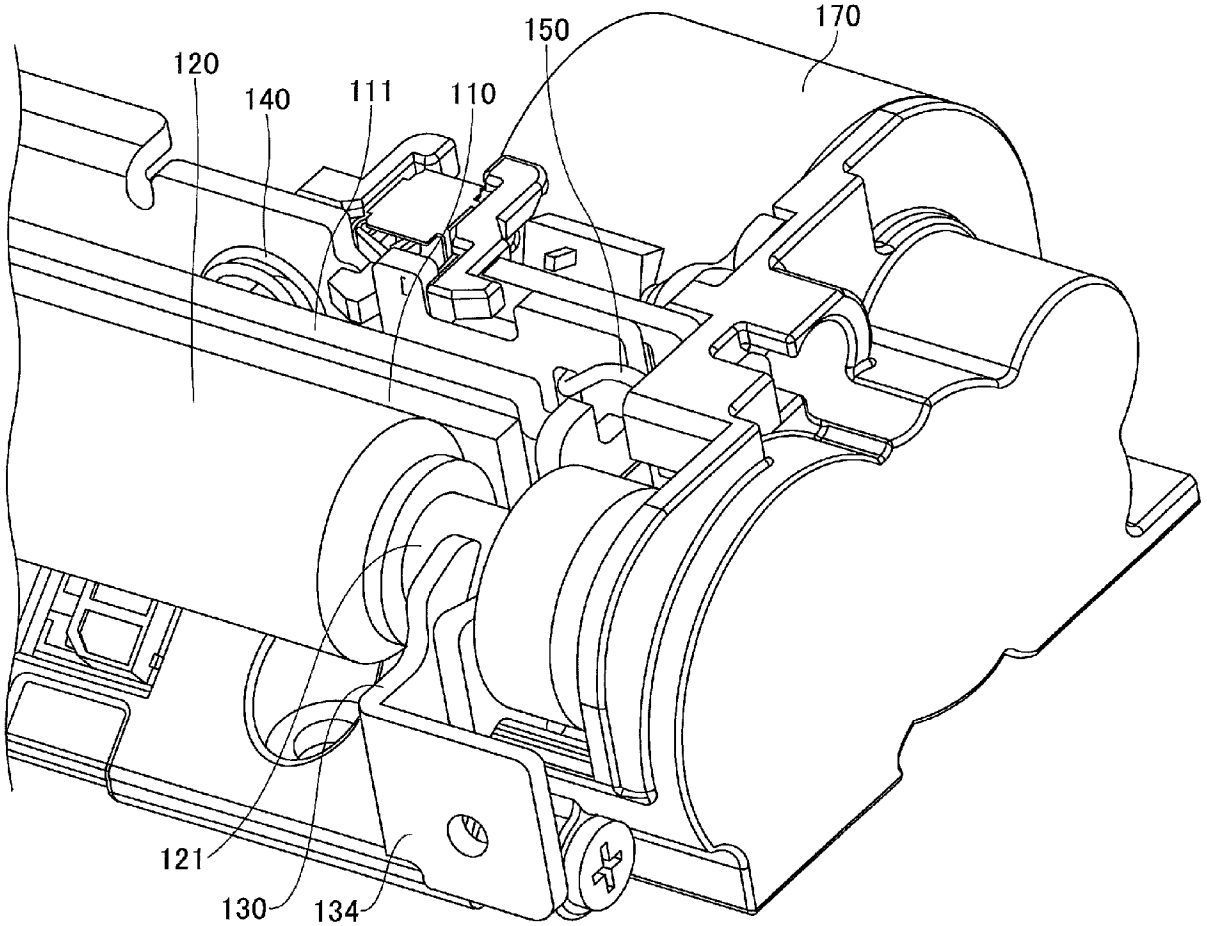
FIG. 2 is an explanatory diagram of the printer apparatus of the embodiment observed diagonally (1)
Figure 3:
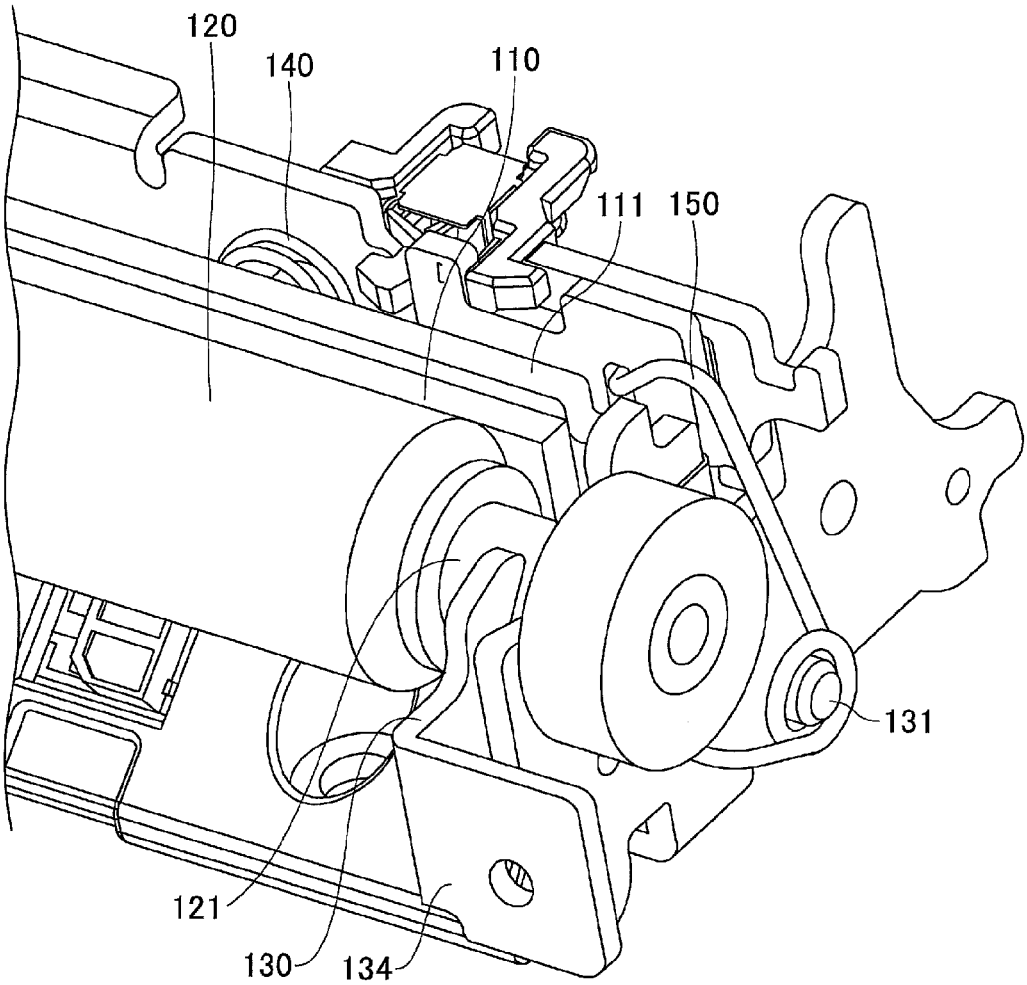
FIG. 3 is an explanatory diagram of the printer apparatus of the embodiment observed diagonally (2)

A printer apparatus according to an embodiment is described with reference to FIGS. 1-3. FIG. 1 is a perspective view of a printer apparatus according to the embodiment, FIG. 2 is a perspective view illustrating the printer apparatus viewed from another angle in a state a housing cover is attached to the printer apparatus, and FIG. 3 is a perspective view illustrating the printer apparatus from the same angle as FIG. 2 in a state where a gear part 180 and other elements are removed from the printer apparatus. As illustrated in FIGS. 1-3, the printer apparatus of the embodiment includes a thermal head 110 which is a printer head, a platen roller 120, an opening/closing arm 130, a first biasing spring 140, and a second biasing spring 150. The thermal head 110, the platen roller 120, the opening/closing arm 130, the first biasing spring 140, and the second biasing spring 150 are mounted to the frame 160. In the printer apparatus of the embodiment, the platen roller 120 is supported by the frame 160 by force exerted from the first biasing spring 140. In this embodiment, a coil spring, a leaf spring or the like may be used as the first biasing spring 140, and a torsion spring or the like may be used as the second biasing spring.

A platen bearing 121 of the platen roller 120 is rotatably supported by a frame side 161 of the frame 160. A motor 170 for rotating the platen roller 120 is provided to the frame 160. By rotating the motor 170, the platen roller 120 is rotated via the gear part 180.

A heat sink 111 corresponding to a head support plate is provided to a rear surface of the thermal head 110. The frame 160 includes a frame rear surface part 162 facing the heat sink 111. The first biasing spring 140 such as a coil spring is provided between the heat sink 111 and the frame rear surface part 162 of the frame 160. The thermal head 110 is pressed toward a side in which the platen roller 120 is provided owing to a recovering force of the first biasing spring 140 transmitted via the heat sink 111.

The opening/closing arm 130 is supported by the frame side surface 161 to rotate and move about the arm rotation shaft 131. The second biasing spring 150 such as a torsion coil spring is provided between the opening/closing arm 130 and the frame side surface 161. Specifically, although not illustrated in the drawings, one end of the second biasing spring 150 is connected to the frame part 160 and the other end of the second biasing spring 150 is connected to the opening/closing arm 130. The opening/closing arm 130 can be rotated and moved about the arm rotation shaft 131 by pressing an opening/closing arm cap receiving part 134. By releasing the force exerted to the opening/closing arm cap receiving part 134, the opening/closing arm cap receiving part 134 moves upward by the recovering force of the second biasing spring 150. Thereby, the opening/closing arm 130 returns to its initial state.

<Frame 160>

Figure 4:
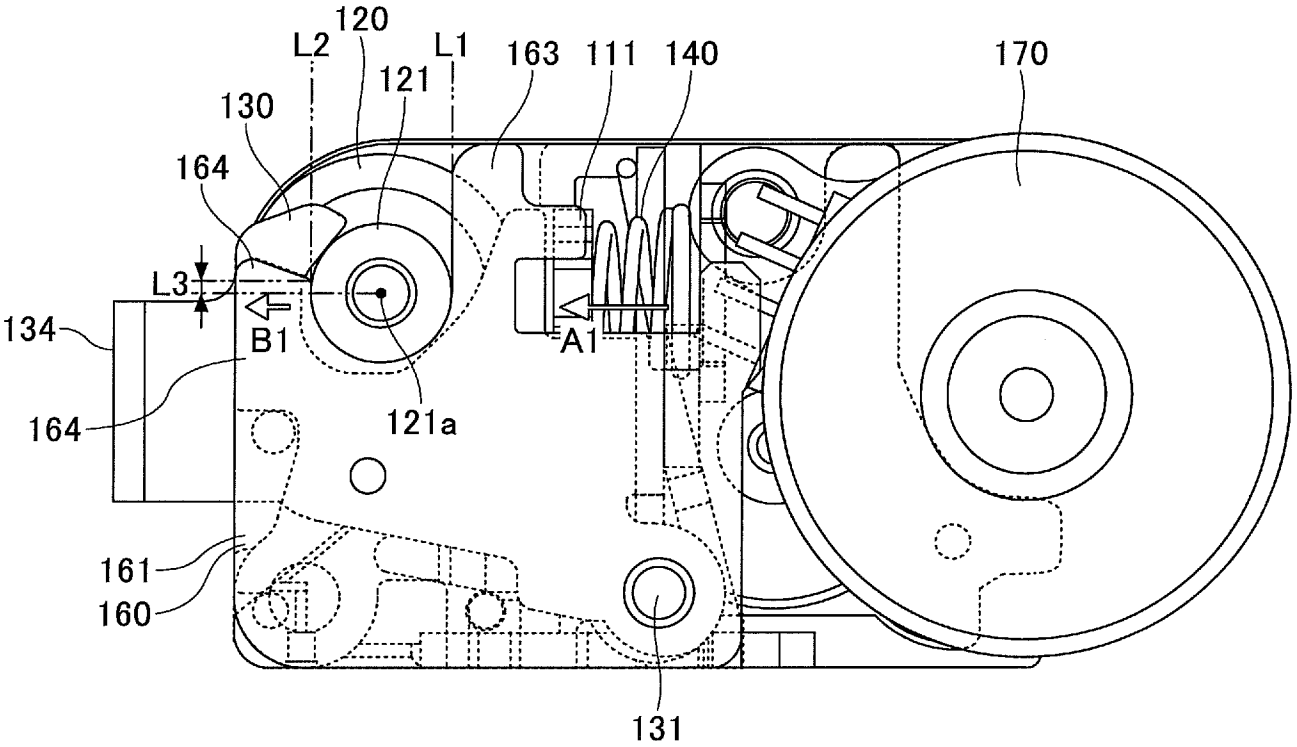
FIG. 4 is an explanatory diagram of the printer apparatus of the embodiment observed from its side.
Figure 5:
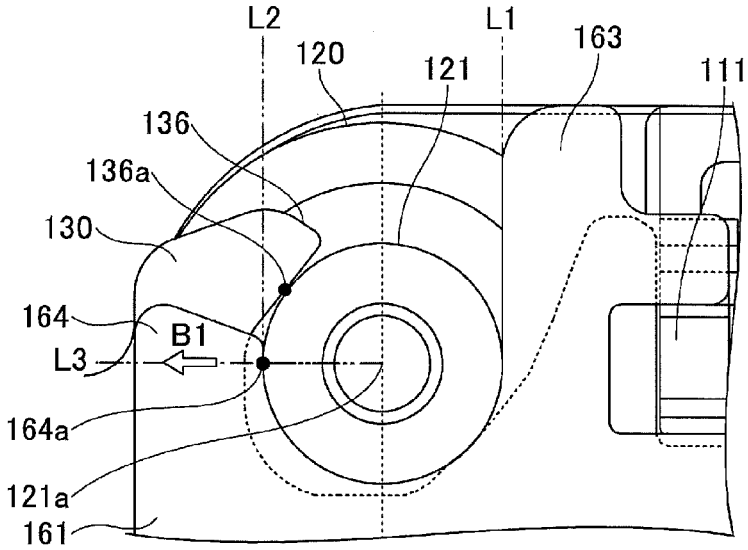
FIG. 5 is an enlarged partial view of FIG. 4.
Figure 6:
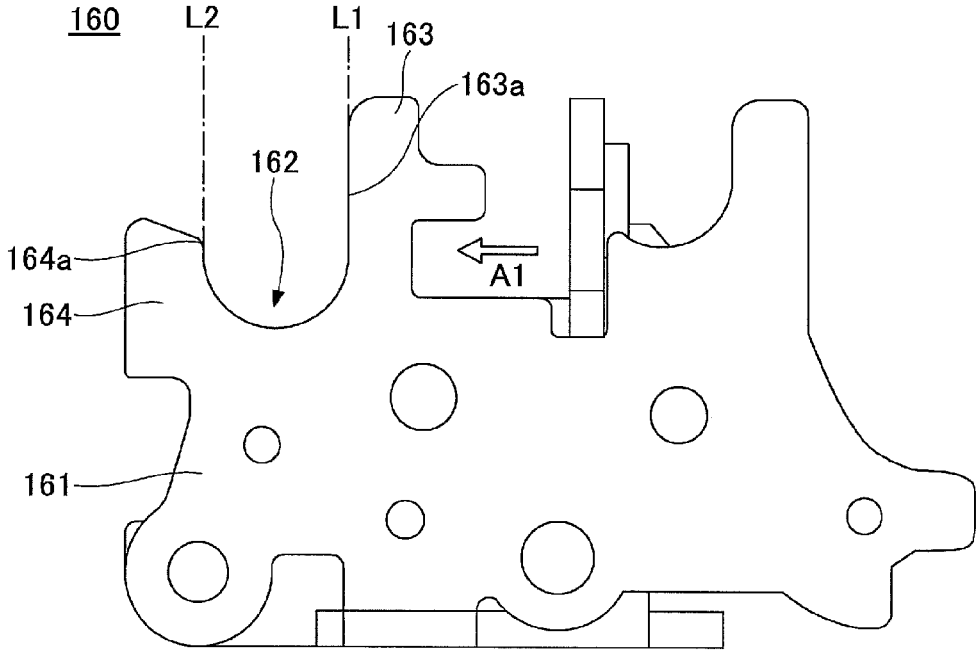
FIG. 6 is an explanatory diagram of a frame 160.

Next, the frame 160 is described with reference to FIGS. 4-6. FIG. 4 is a side view illustrating the printer apparatus of the embodiment, FIG. 5 is an enlarged view of a portion of FIG. 4, and FIG. 6 is a side view of the frame 160.

A frame opening part 162 into which the platen bearing 121 can be guided is provided in the frame side surface 161 of the frame 160 for supporting the platen roller 120. The frame opening 162 is formed in a U-shape. First guide part 163 and the second guide part 164 are formed at an inlet part of the frame opening part 162 for guiding the platen bearing 121 into the frame opening part 162. The first guide part 163 is formed on a side more toward the thermal head 110 (heat sink 111) than the second guide part 164. The first guide part 163 is formed longer than the second guide part 164. A line L1 extends along a straight edge part 163*a* formed in the frame opening part 162, and a line L2 extends along a straight edge part 164*a* formed in the frame opening part 162 are formed to be substantially parallel to each other. Further, the line L1 and the line L2 are formed in a direction that is substantially orthogonal to a direction of a recovery force of the first biasing member 140 of the embodiment. In the printer apparatus of the present invention, the platen bearing 121 is supported by contacting an insulating part 164*a* of the second guide part 164 by the recovering force of the first biasing spring 140. Therefore, the line L2 becomes a tangential line between the edge part 164*a* of the second guide part 164 and the platen bearing 121.

The edge part 164*a* of the second guide part 164 is formed on a line L3 that runs through a center 121*a* of the platen bearing 121. Alternatively, the edge part 164*a* of the second guide part 164 may be formed above the line L3 in the drawing. In the second guide part 164 of the printer apparatus according to this embodiment, the straight edge part 164*a* overlapping the line L2 may be formed to have a length of approximately 0.2 mm.

<Opening/Closing Arm>

Figure 7:
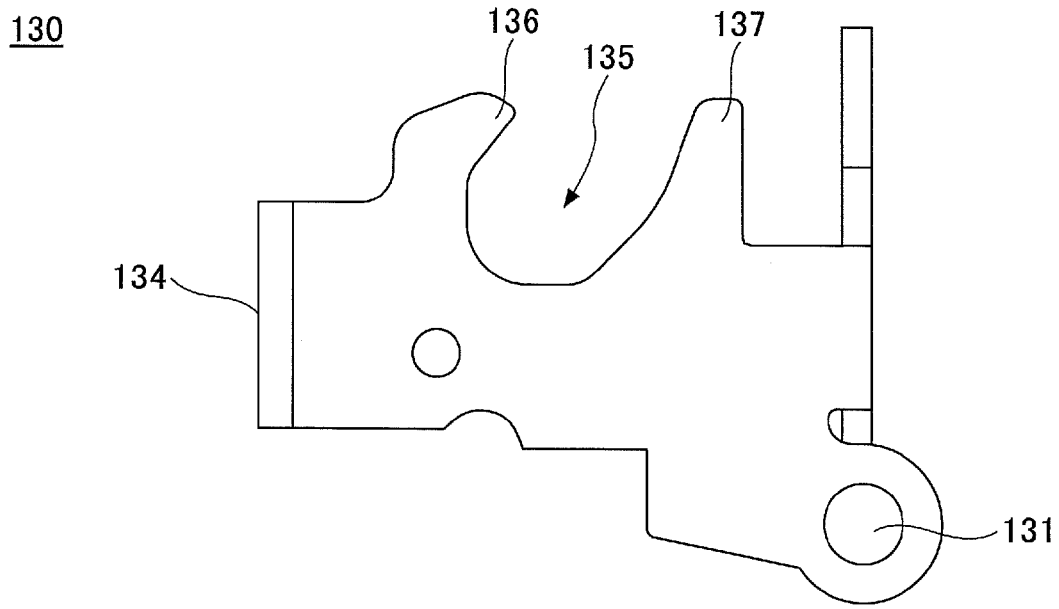
FIG. 7 is an explanatory diagram of an opening/closing arm 130.

Next, the opening/closing arm 130 is described with reference to FIGS. 4, 5, and 7. The opening/closing arm 130 is rotated and moved about the arm rotation shaft 131 by pressing the opening/closing arm cap receiving part 134. An opening/closing arm opening part 135 into which the platen bearing 121 of the platen roller 120 is inserted is provided in an opening/closing arm side surface. A lock part 136 is provided at a position that is the edge of the opening/closing arm opening part 135 and farthest from the arm rotation shaft 131. An outer contact part 137 for pressing out the platen bearing 121 during the below-described removal of the platen roller 120 is provided on the side opposite from the lock part 136 interposed by the opening/closing arm opening part 135. FIG. 7 is a side view of the opening/closing arm 130.

The platen bearing 121 of the platen roller 120 according to this embodiment is pressed by the recovering force of the first biasing spring 140 in the direction of the arrow A1 as illustrated in FIG. 4. Further, the frame 160 is pressed by the platen bearing 121 in the direction of the arrow B1 in FIG. 4. Accordingly, the platen bearing 121 is rotatably supported by the frame 160. That is, the platen bearing 121 is supported in a state provided in the opening/closing arm opening part 135 while being supported by the frame 160 with respect to the biasing direction of the recovering force of the first biasing spring 140 illustrated with the arrow A1. Accordingly, the platen bearing 121 does not contact the opening/closing arm 130 with respect to the direction illustrated with the arrow B1. Therefore, the platen bearing 121 is not supported by the opening/closing arm 130.

The platen bearing 121 contacts the lock part 131 of the opening/closing arm 130 at a contact point 136*a*, so that the platen bearing 121 can be prevented from moving in an upward/downward direction in FIG. 5. Accordingly, the lock part 136 does not support the platen bearing 121 with respect to the biasing direction of the recovering force of the first biasing spring 140 illustrated with the arrow A1 but is for preventing the platen bearing 121 from moving in a direction that is substantially orthogonal to the direction illustrated with the arrow A1.

<Relationship Between Opening/Closing Arm 130 and Platen Bearing 121>

Next, a relationship between the opening/closing arm 130 and the platen bearing 121 of the printing apparatus of this embodiment is described with reference to FIGS. 8 and 9. The below-described projecting part 138 is provided in a part of the side surface of the opening/closing arm 130.

The printer apparatus of this embodiment has a structure in which the platen roller 120 can easily detach from the printer apparatus when, for example, a force no less than a predetermined amount is exerted when the printer apparatus is dropped. Accordingly, even if, for example, the printer apparatus is dropped, a large amount of force is not applied to the platen bearing 121 and the like via the opening/closing arm 130 and the like. Thus, a component formed of a mold resin such as the platen bearing 121 can be prevented from being damaged.

Figure 8:
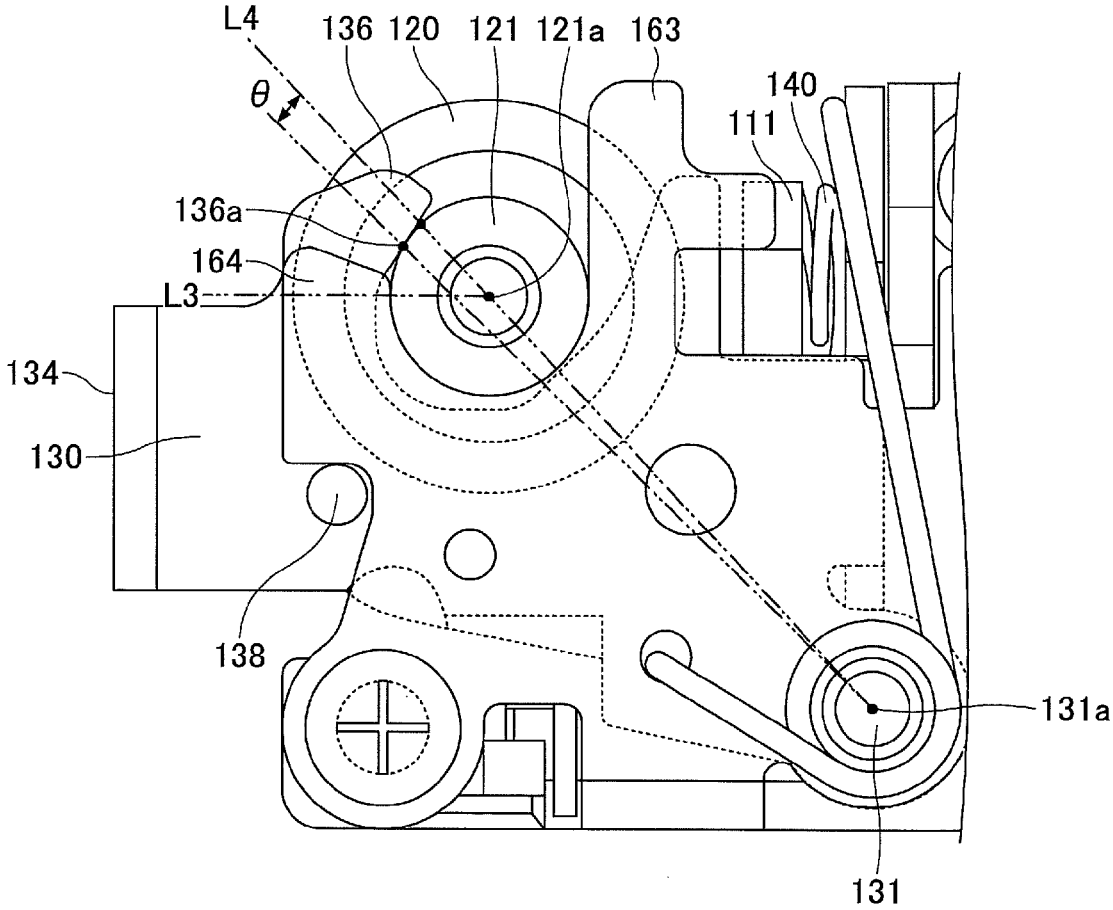
FIG. 8 is an explanatory diagram of a contact point 136*a* between the opening/closing arm 130 and a platen bearing 121.

Specifically, the contact point 136*a* between the platen bearing 121 and the lock part 136 of the opening/closing arm 130 is positioned opposite from the side in which the thermal head 110 (heat sink 111) and the first biasing spring 140 are provided with respect to a line L4 illustrated in FIG. 8. FIG. 8 illustrates the line L4 as a chain double-dashed line that connects a center 131*a* of the arm rotation shaft 131 and the center 121*a* of the platen bearing 121. That is, the contact point 136*a* is formed in a position opposite from the direction in which the platen roller 120 is disengaged (illustrated with an arrow C1) with respect to the line L4.

By forming the contact point 136*a* in a position opposite from the direction in which the platen roller 120 is disengaged (illustrated with the arrow C1 of FIG. 9) with respect to the line L4, a force is exerted to the platen roller 120 in a direction causing the disengagement of the platen roller 120 (illustrated with the arrow C1 of FIG. 9) when, for example, the printer apparatus is dropped. Further, the platen roller 120 can easily disengage because the opening/closing arm 130 can be moved even when the force exerted in the disengaging direction of the platen roller 120 is relatively small.

A case of forming the contact point in a position on the side of the disengaging direction of the platen roller 120 as illustrated with the arrow C1 (i.e. the side in which the thermal head 110 is provided) with respect to the line L4 is described. In this case, a force is exerted to the platen roller 120 in a direction causing the removal of the platen roller 120 as illustrated with the arrow C1. However, because the opening/closing arm 130 cannot be moved unless the force is significantly large, the platen roller 120 cannot disengage. The force that is exerted to the printer apparatus in the direction causing removal of the platen roller 120 is also exerted to the platen bearing 121 of the platen roller 120 via the opening/closing arm 130. Therefore, the platen bearing 121 may be damaged by the exerted force.

Figure 10A:
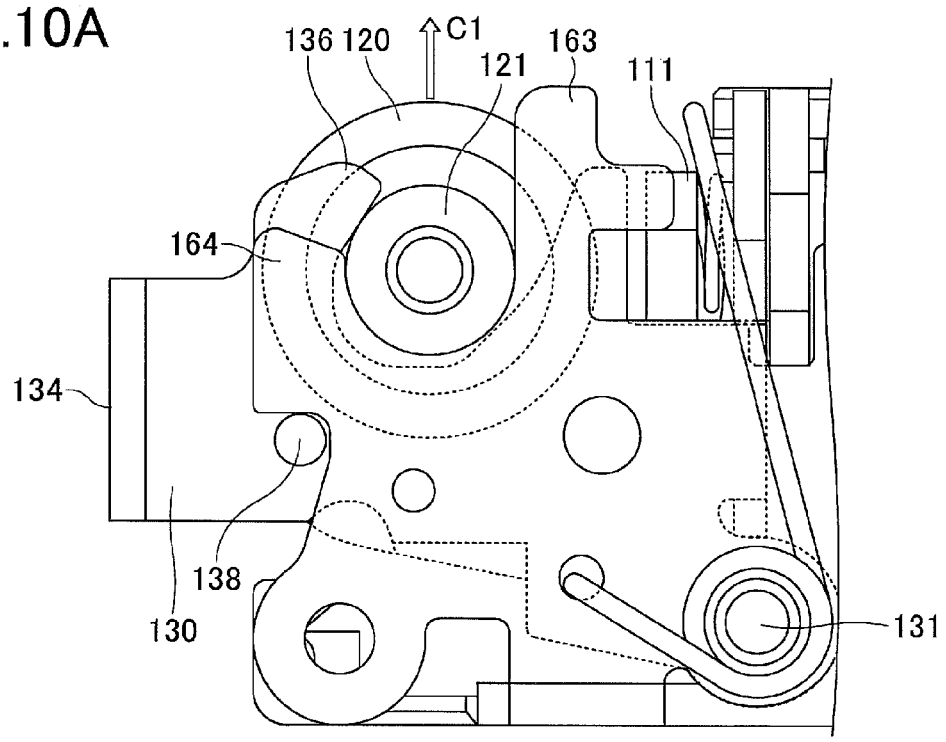
FIGS. 10A-10B are explanatory diagrams in a case where a platen roller 120 is disengaged.
Figure 10B:
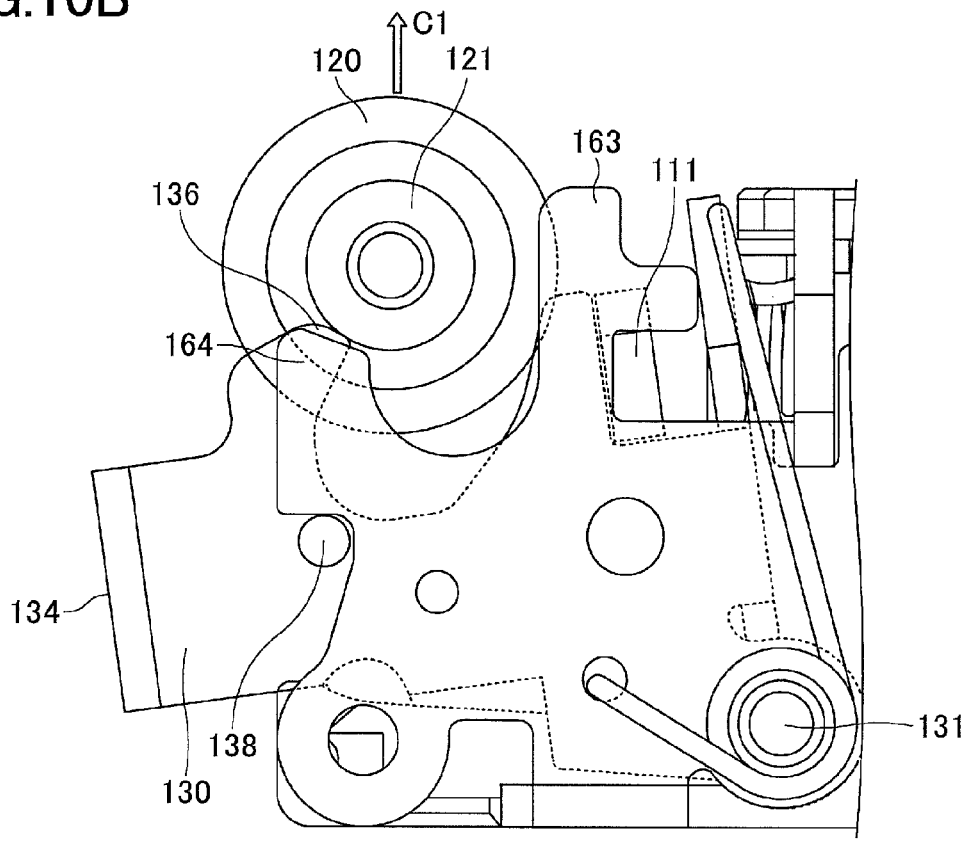

With the printer apparatus of this embodiment, the platen roller 120 can easily disengage from the printer apparatus when force is exerted to the platen roller 120 in the direction illustrated with the arrow C1. Therefore, the platen bearing 121 or the like can be prevented from being damaged. That is, in a state of FIG. 10A, the printer apparatus of this embodiment can easily shift to a state of FIG. 10B when force is exerted in the direction C causing removal of the platen roller 120. Thus, the platen roller 120 can easily disengage from the printer apparatus. Accordingly, the platen bearing 121 or the like can be prevented from being damaged.

Figure 9:
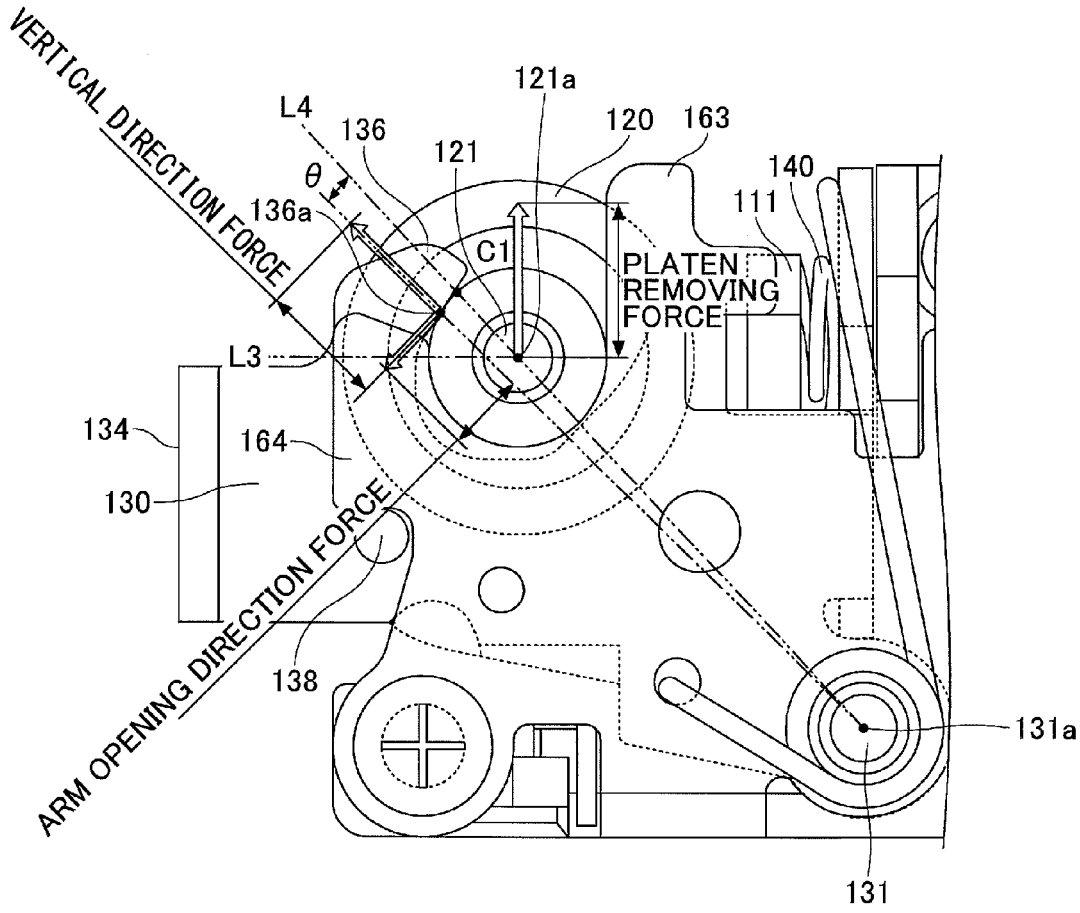
FIG. 9 is an explanatory diagram of force exerted to the contact point 136*a;*

As illustrated in FIG. 9, the amount of force exerted to the platen roller 120 of the printer apparatus during the removing of the platen roller 120 depends on the size of the angle θ formed by the line L4 and the contact point 136*a*. Specifically, if the value of the angle θ is small, the platen roller 120 cannot disengage unless a relatively large amount of force is exerted to the printer apparatus. If the value of the angle θ is large, the platen roller 120 can easily disengage even when an amount of force exerted to the printer apparatus is small.

The amount of force required to disengage the platen roller 120 from the printer apparatus may differ depending on the purpose or usage of the printer apparatus. With the printer apparatus of this embodiment, the amount of force required for the platen roller 120 to disengage from the printer apparatus can be adjusted by adjusting the angle θ, that is, the position of the contact point 136*a*. In the printer apparatus of this embodiment, the contact point 136*a* is formed to be positioned between the line L3 and the line L4.

<Position Adjustment of Contact Point Between Opening/Closing Arm 130 and Platen Bearing 121>

In a case where the contact point 136*a* is positioned between the line L3 and the line L4 as illustrated in FIG. 9, the amount of force that causes the platen roller 120 to disengage from the printer apparatus may be changed due to a slight change in the position of the contact point 136*a*. That is, even in a case where the printer apparatus is designed to cause the platen roller 120 to disengage from the printer apparatus when a predetermined amount of force is exerted to the printer apparatus, the position of the contact point 136*a* may deviate from a desired position due to, for example, manufacturing error. Thus, some printer apparatuses may cause the platen roller 120 to disengage from the printer apparatus whereas some printer apparatus may cause the platen roller 120 not disengage from the printer apparatus. Thus, if the platen roller 120 is not disengaged from the printer apparatus even when a large amount of force is exerted to the printer apparatus, the printer apparatus may be damaged when, for example, the printer apparatus is dropped.

Figure 11:
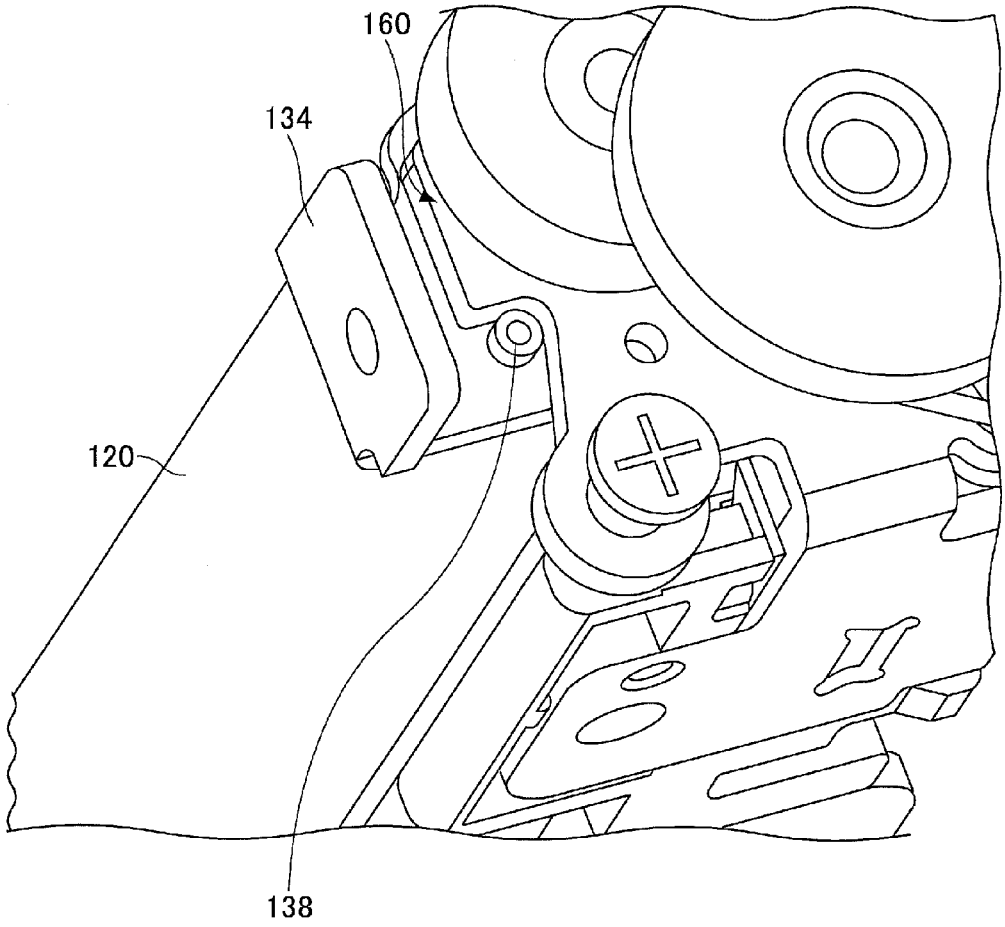
FIG. 11 is an explanatory diagram of a projecting part 138 provided in the opening/closing arm 130 (1)
Figure 12:
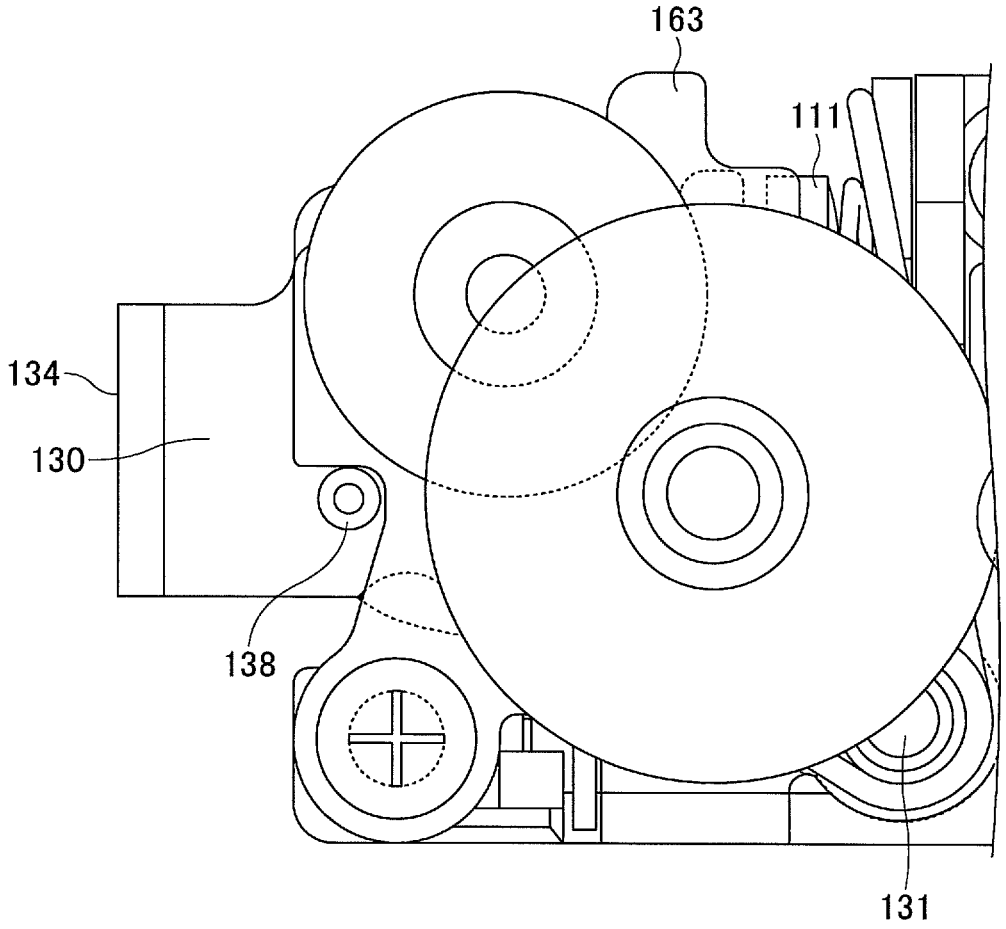
FIG. 12 is an explanatory diagram of the projecting part 138 provided in the opening/closing arm 130 (2)

Therefore, in this embodiment, the projecting part 138 is provided in the opening/closing arm 130 as illustrated in FIGS. 11 and 12.

By allowing the projecting part 138 and the frame 160 to contact each other, the platen bearing 121 and the lock part 136 of the opening/closing arm 130 can contact at a predetermined position which is the contact point 136*a*.

Accordingly, with the printer apparatus of this embodiment, the platen roller 120 can almost always disengage from the printer apparatus when a substantially constant amount of force is exerted to the printer apparatus. Thereby, the platen bearing 121 or the like can be further prevented from being damaged.

<Operation of Opening/Closing Arm>

Next, an operation of the opening/closing arm of the printer apparatus according to the embodiment is described with reference to FIGS. 13A-16B.

Figure 13A:
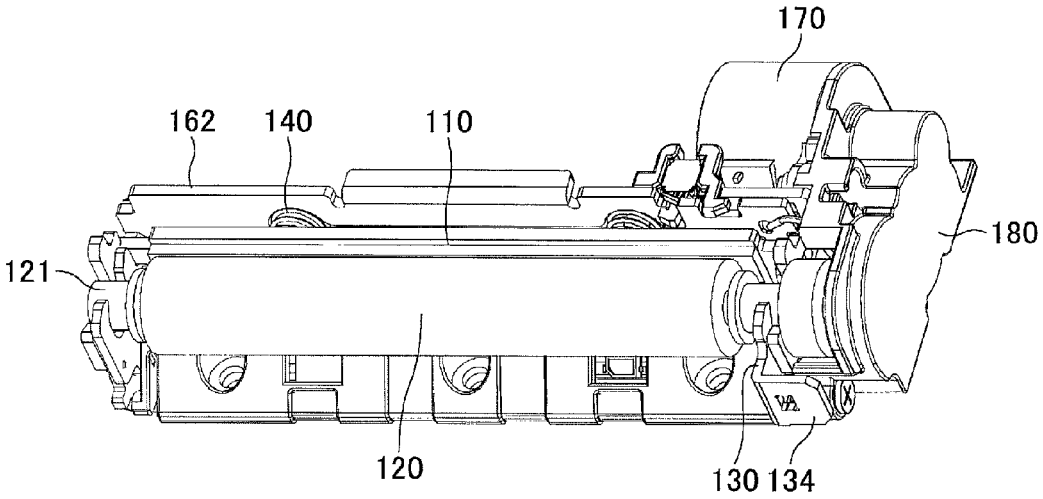
FIGS. 13A-13B are explanatory diagrams of the printer apparatus of the embodiment (1)
Figure 13B:
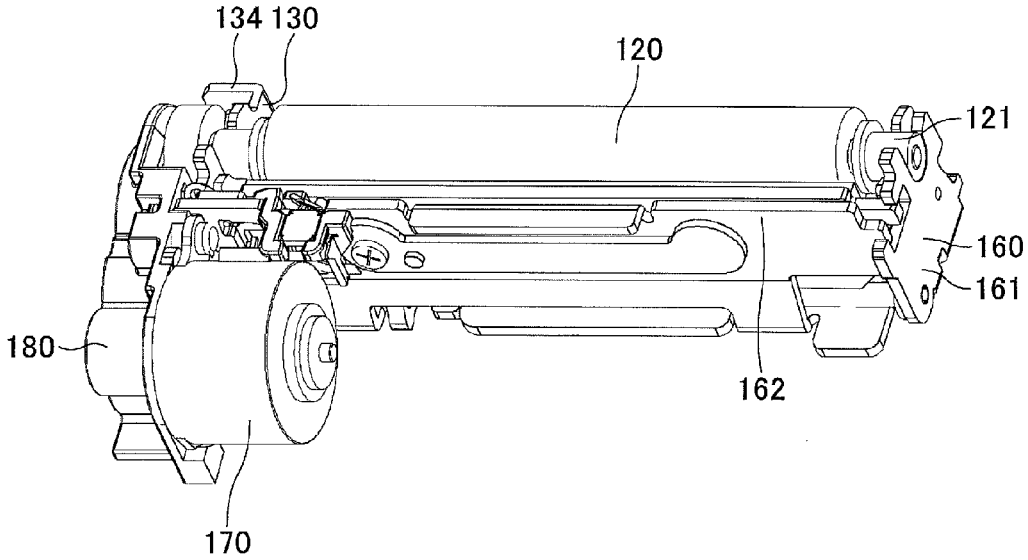
Figure 14A:
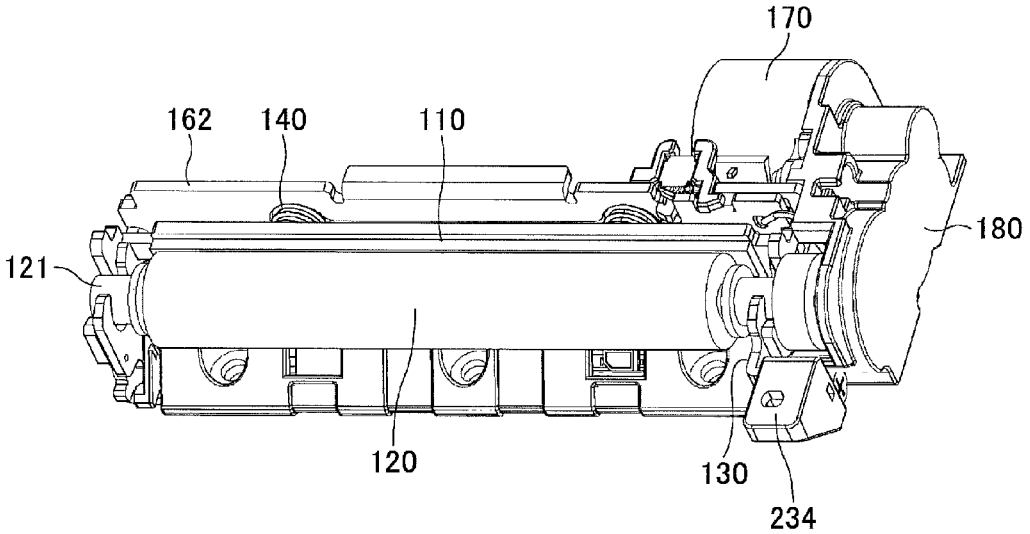
FIGS. 14A-14B are explanatory diagrams of the printer apparatus of the embodiment (2)
Figure 14B:
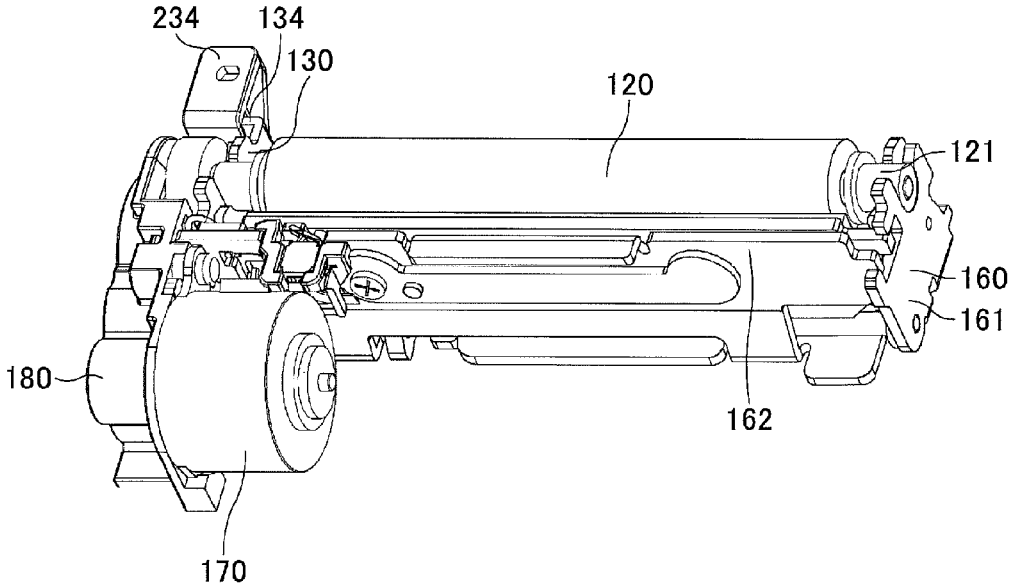
Figure 15A:
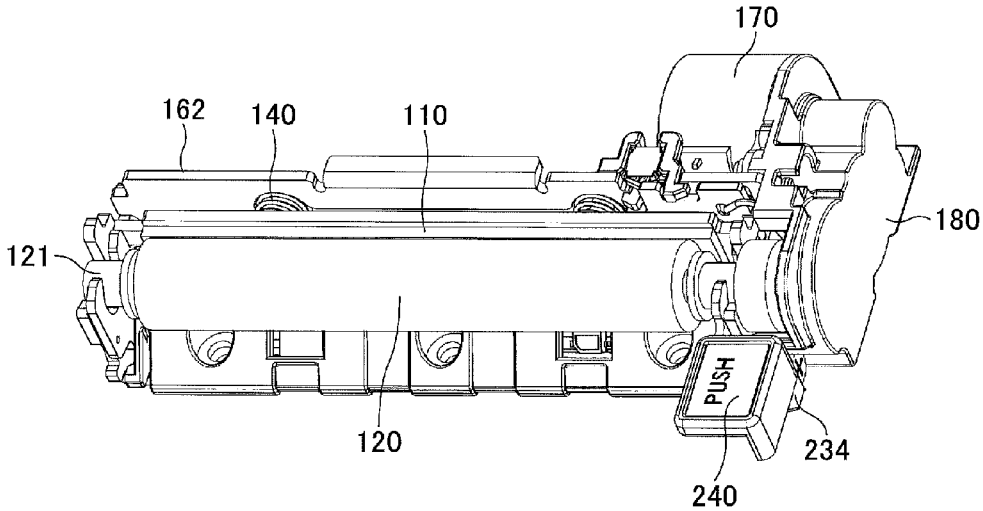
FIGS. 15A-15B are explanatory diagrams of the printer apparatus of the embodiment (3)
Figure 15B:
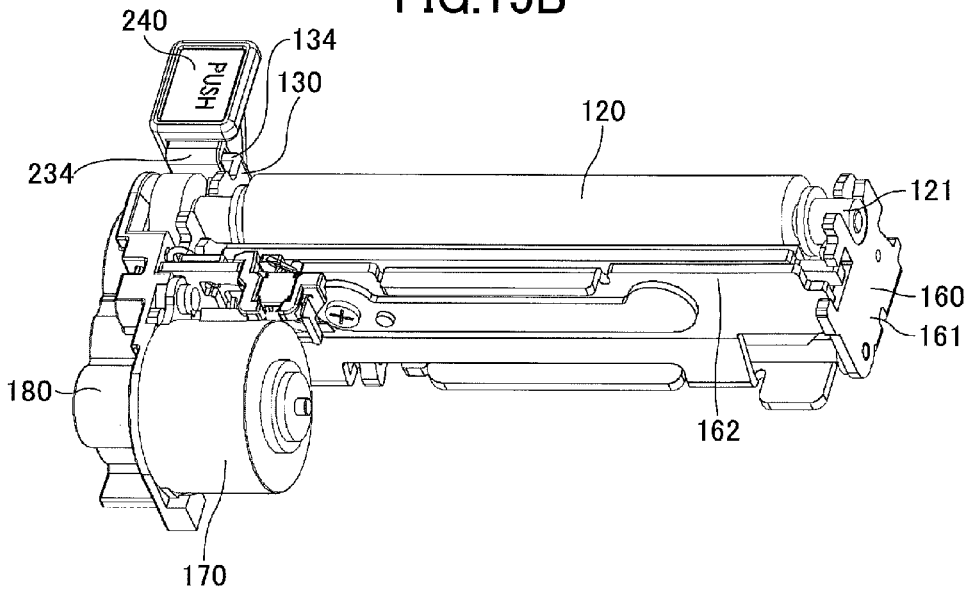
Figure 16A:
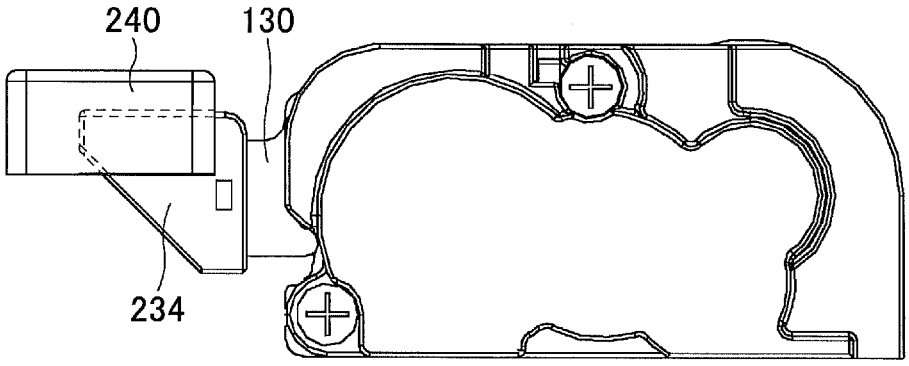
FIGS. 16A-16B are explanatory diagrams of the printer apparatus of the embodiment (4).
Figure 16B:
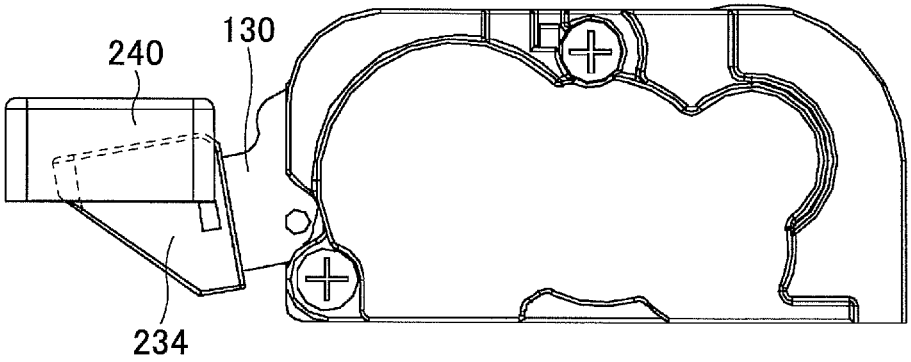

FIGS. 13A and 13B illustrate the printer apparatus of the embodiment in a state prior to having a lever cap 234 attached thereto. Assuming that the side in which the platen 120 is provided corresponds to the front side, FIG. 13A is a perspective view of the printer apparatus observed from the front side, and FIG. 13B is a perspective view of the printer apparatus observed from the rear side. FIGS. 14A and 14B illustrate the printer apparatus of the embodiment in a state having the lever cap 234 attached thereto. FIG. 14A is a perspective view of the printer apparatus observed from the front side, and FIG. 14B is a perspective view of the printer apparatus observed from the rear side. FIGS. 15A and 15B illustrate the printer apparatus of the embodiment in a state having a depression button 240 attached thereto. FIG. 15A is a perspective view of the printer apparatus observed from the front side, and FIG. 15B is a perspective view of the printer apparatus observed from the rear side. FIG. 16A illustrates a state where the depression button 240 is not yet pressed, and FIG. 16B illustrates a state where the depression button 240 is pressed.

In the printer apparatus of the embodiment, the opening/closing arm cap receiving part 134 is provided in the opening/closing arm 130 as illustrated in FIGS. 13A and 13B. However, in actual use, the lever cap 234 is attached to the opening/closing arm cap receiving part 134 as illustrated in FIGS. 14A and 14B, and the depression button 240 is attached to the lever cap 234 as illustrated in FIGS. 15A and 15B. Accordingly, the opening/closing arm 130 can be operated to move by pressing the depression button 240 interposed by the lever cap 234 and the opening/closing arm cap receiving part 134. That is, the lever cap 234 is lowered from the state illustrated in FIG. 16A to the state illustrated in FIG. 16B by depressing the depression button 240. Thereby, the opening/closing arm 130 is operated to move about the arm rotation shaft 131.

According to the above-described embodiment of the present invention, there can be provided a printer apparatus that can be steadily used for a long period owing to its resistance to damage even in a case where, for example, impact is applied to the printer apparatus when the printer apparatus is dropped.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

The invention claimed is:

1. A printer apparatus comprising:

a frame;

a printer head;

a platen roller that is supported by the frame;

a biasing member that is provided between the frame and the printer head and configured to exert force toward the platen roller; and an opening/closing arm supported by the frame to rotate and move about an arm rotation shaft;

wherein a platen bearing of the platen roller contacts the opening/closing arm only at a single point, wherein the single point is positioned opposite from a side in which the printer head is provided with respect to a line that connects a center of the arm rotation shaft and a center of the platen bearing.

2. The printer apparatus as claimed in claim 1, wherein the platen roller is supported by the frame by way of a recovering force of the biasing member via the printer head, wherein the platen roller can be disengaged by moving the opening/closing arm about the arm rotation shaft.

3. The printer apparatus as claimed in claim 1, wherein the single point is a contact point corresponding to a point of contact.

4. The printer apparatus as claimed in claim 1, wherein a projecting part that contacts the frame is provided in the opening/closing arm, wherein a position of the single point is defined by the projecting part of the opening/closing arm contacted to the frame.

5. The printer apparatus as claimed in claim 1, wherein the frame includes a frame opening having a U-shape in which both ends of the U-shape extend parallel to each other.

6. A printer, comprising:

a platen roller comprises a bearing;

a print head;

a frame that supports the platen roller;

an arm rotatably supported by the frame and contacts with the bearing; and a biasing member that exerts force to the print head toward the platen roller;

wherein the arm contacts with the bearing at a side opposite from a side in which the print head is provided with respect to a line that connects a center of a rotation axis of the arm and the center of the platen bearing, and does not contact with the bearing at the side in which the print head is provided with respect to the line.

7. A printer, comprising:

a frame;

a platen roller that is detachably supported by the frame and comprises a bearing; and an arm supported by the frame to rotate about a rotation shaft, and contacts with the bearing;

wherein the arm only contacts with the bearing at a point positioned at a side opposite from a side in which the platen roller is disengaged from the frame with respect to a line that connects a center of the rotation shaft and the center of the platen bearing.

* * * * *